US006430838B1

(12) United States Patent
Yang

(10) Patent No.: US 6,430,838 B1
(45) Date of Patent: Aug. 13, 2002

(54) DEHUMIDIFIER DRYING APPARATUS

(76) Inventor: Shih Hsein Yang, 4Fl., 41, Lane 46, Hu Lin Street, Taipei (TW)

( * ) Notice: Subject to any disclaimer, the term of this patent is extended or adjusted under 35 U.S.C. 154(b) by 0 days.

(21) Appl. No.: 09/872,977

(22) Filed: May 31, 2001

(51) Int. Cl.[7] ..... F26B 19/00; F26B 25/06

(52) U.S. Cl. ..... 34/71; 34/417; 34/202; 34/215; 34/DIG. 1; 34/242

(58) Field of Search ..... 34/417, 443, 501, 34/502, 175, 201, 202, 209, 210, 215, 218, 237, 238, DIG. 1, 71, 634, 242

(56) References Cited

U.S. PATENT DOCUMENTS 4,406,071 A * 9/1983 Buchanan ..... 34/91
4,558,526 A * 12/1985 Baus ..... 34/232
5,014,446 A * 5/1991 Reesman ..... 34/151
5,025,572 A * 6/1991 Cordier ..... 34/202
5,802,735 A * 9/1998 Schoonhoven ..... 34/174
6,018,885 A * 2/2000 Hill ..... 34/202
6,035,545 A * 3/2000 Jones ..... 34/202
6,263,591 B1 * 7/2001 La Porte ..... 34/622

* cited by examiner

*Primary Examiner*—Ira S. Lazarus
*Assistant Examiner*—K. B. Rinehart
(74) *Attorney, Agent, or Firm*—Pro-Techtor International Services

(57) ABSTRACT

A dehumidifier drying apparatus adapted to dry saturated drying agent of dehumidifiers, including a top-open drying box, the drying box having an air inlet, a detachable seal cover covered on the drying box and adapted to hold saturated drying agent for drying, the detachable seal cover having a plurality of air vents, and a hot air source, for example, a hair dryer adapted to blow hot air through the air inlet of the drying box and the air vents of the detachable seal cover to dry saturated drying agent being put on the detachable seal cover.

4 Claims, 10 Drawing Sheets

DEHUMIDIFIER DRYING APPARATUS

BACKGROUND OF THE INVENTION

The present invent relates to a dehumidifier drying apparatus and, more particularly to such a dehumidifier drying apparatus, which is adapted to dry saturated drying agent of dehumidifiers for a repeat use.

In order to protect storage items against the damage of moisture, people may put dehumidifiers in the cabinets, wardrobes, precious item storage racks, and etc. to absorb moisture in air. FIG. 1 shows a dehumidifier A constructed for this purpose. The drying agent used in this structure of dehumidifier A contains calcium chloride, which produces a toxic alkaline solution when absorbed water from the air. When disposing of the dehumidifier A after its use, the user must carefully handle the dehumidifier A. When disposing of the dehumidifier, the user may touch the toxic alkaline solution with the skin or the eyes accidentally, causing an injury. FIG. 2 shows another structure of dehumidifier according to the prior art. This structure of dehumidifier is complicated to assemble. During the use of the dehumidifier, the user cannot visually check the change of color of the drying agent put inside the casing of the dehumidifier (the change of color is indicative of the moisture absorption status of the drying agent). Further, the aforesaid prior art dehumidifiers are not reusable. Once the contained drying agent is saturated, the dehumidifiers become useless.

SUMMARY OF THE INVENTION

The present invention has been accomplished under the circumstances in view. It is the main object of the present invention to provide a dehumidifier drying apparatus, which is adapted to dry saturated drying agent of dehumidifiers for a repeat use. It is another object of the present invention to provide a dehumidifier drying apparatus, which dries saturated drying agent of dehumidifiers efficiently. To achieve these and other objects of the present invention, the dehumidifier drying apparatus comprises a top-open drying box, the drying box comprising an open top side, and an air inlet in an upright peripheral wall thereof at one side and adapted to receive hot air from a hot air source; a detachable seal cover covered on the open top side of the top-open drying box and adapted to hold saturated drying agent for drying, the detachable seal cover comprising a plurality of air vents through which hot air is delivered from the air inlet to dry saturated drying agent being put on the detachable seal cover; and hot air source adapted to blow hot air through the air inlet of the top-open drying box and the air vents of the detachable seal cover to dry saturated drying agent being put on the detachable sea cover. The hot air source can be, for example, a hair dryer. Further, adapter means, for example, a heat-resisting socket may be installed in the air inlet and adapted to receive the barrel of the hair dryer.

DETAILED DESCRIPTION OF THE PREFERRED EMBODIMENT

Figure 1:
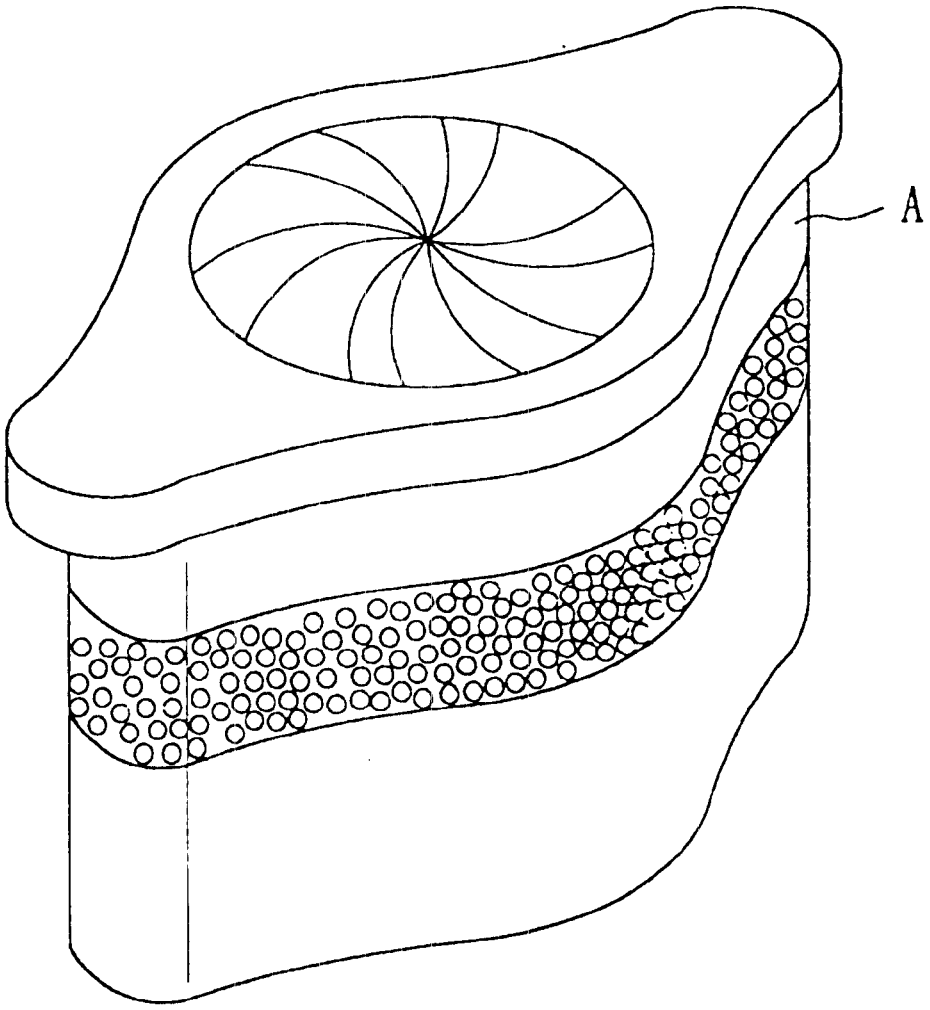
Fig. 1(PRIOR ART)
FIG. 1 is an elevational view of a dehumidifier according to the prior art.
Figure 2:
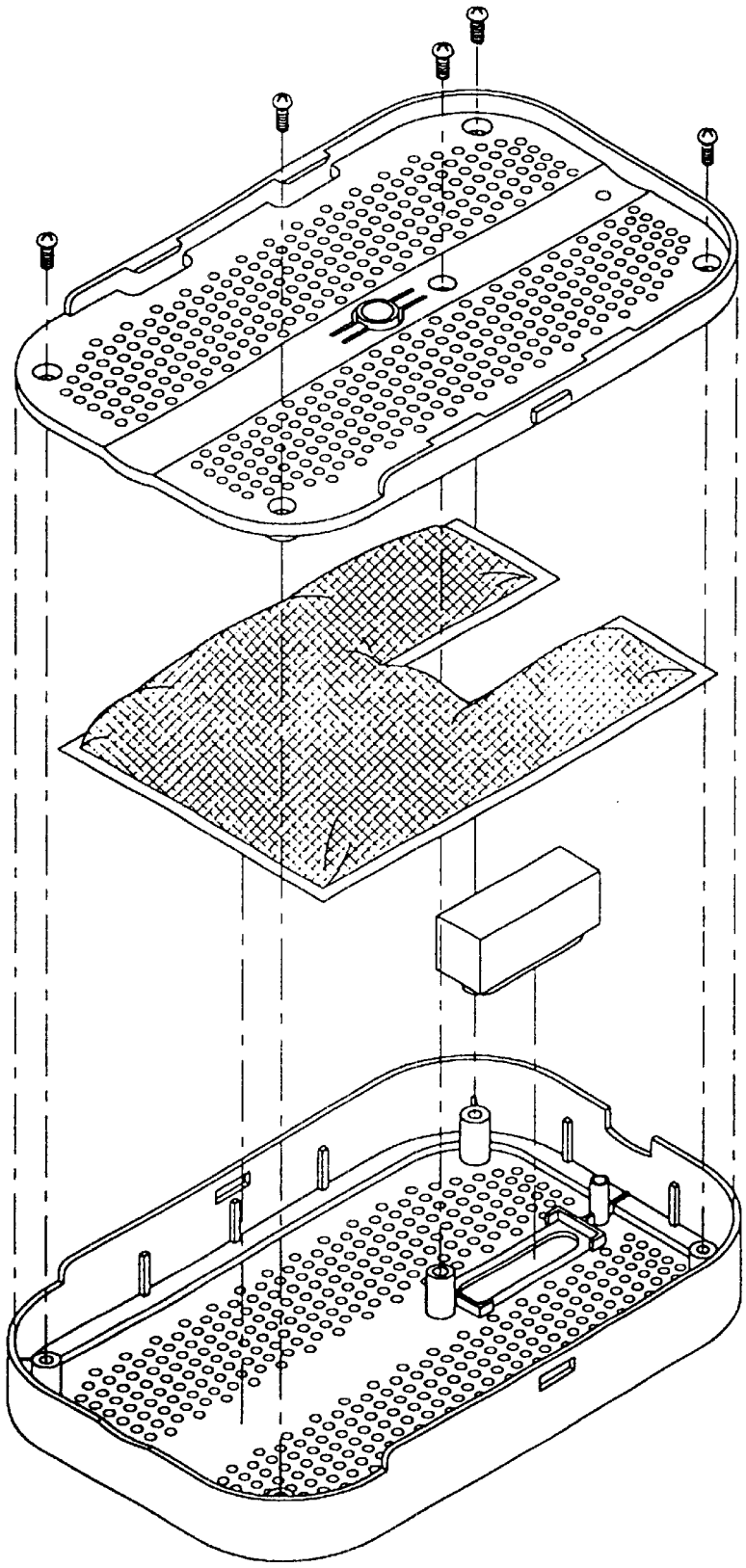
Fig. 2 (PRIOR ART)
FIG. 2 is an exploded view of another structure of dehumidifier according to the prior art.
Figure 3:
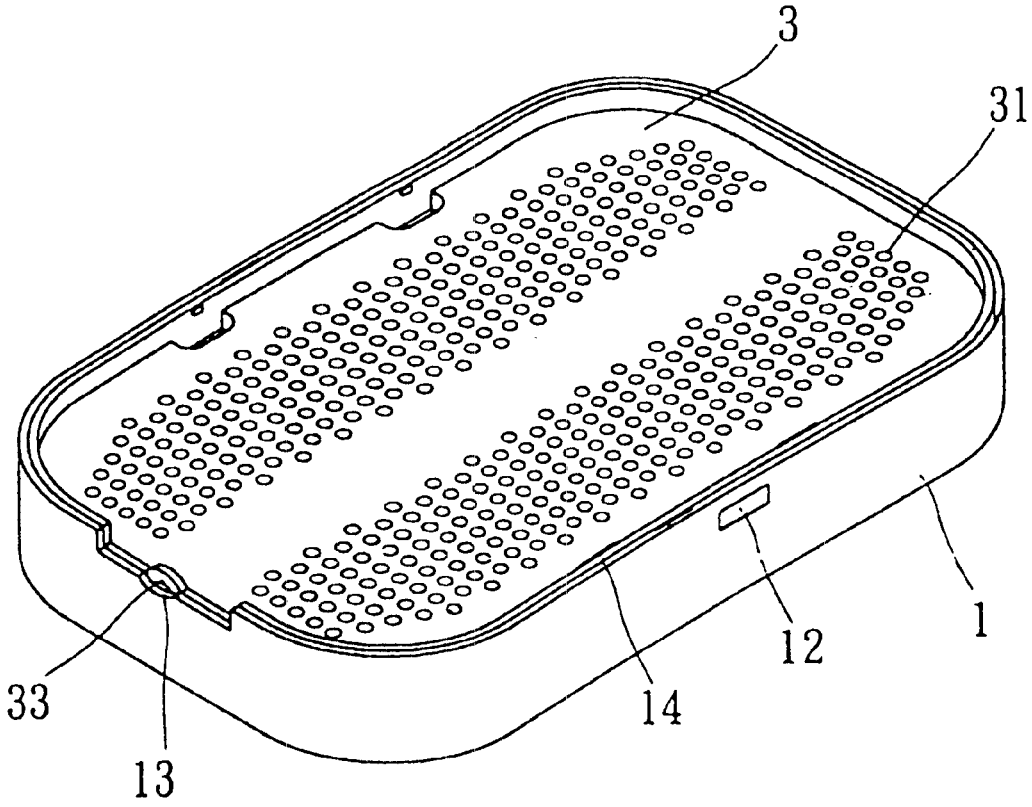
FIG. 3 is an elevational view of a dehumidifier constructed according to the present invention.
Figure 4:
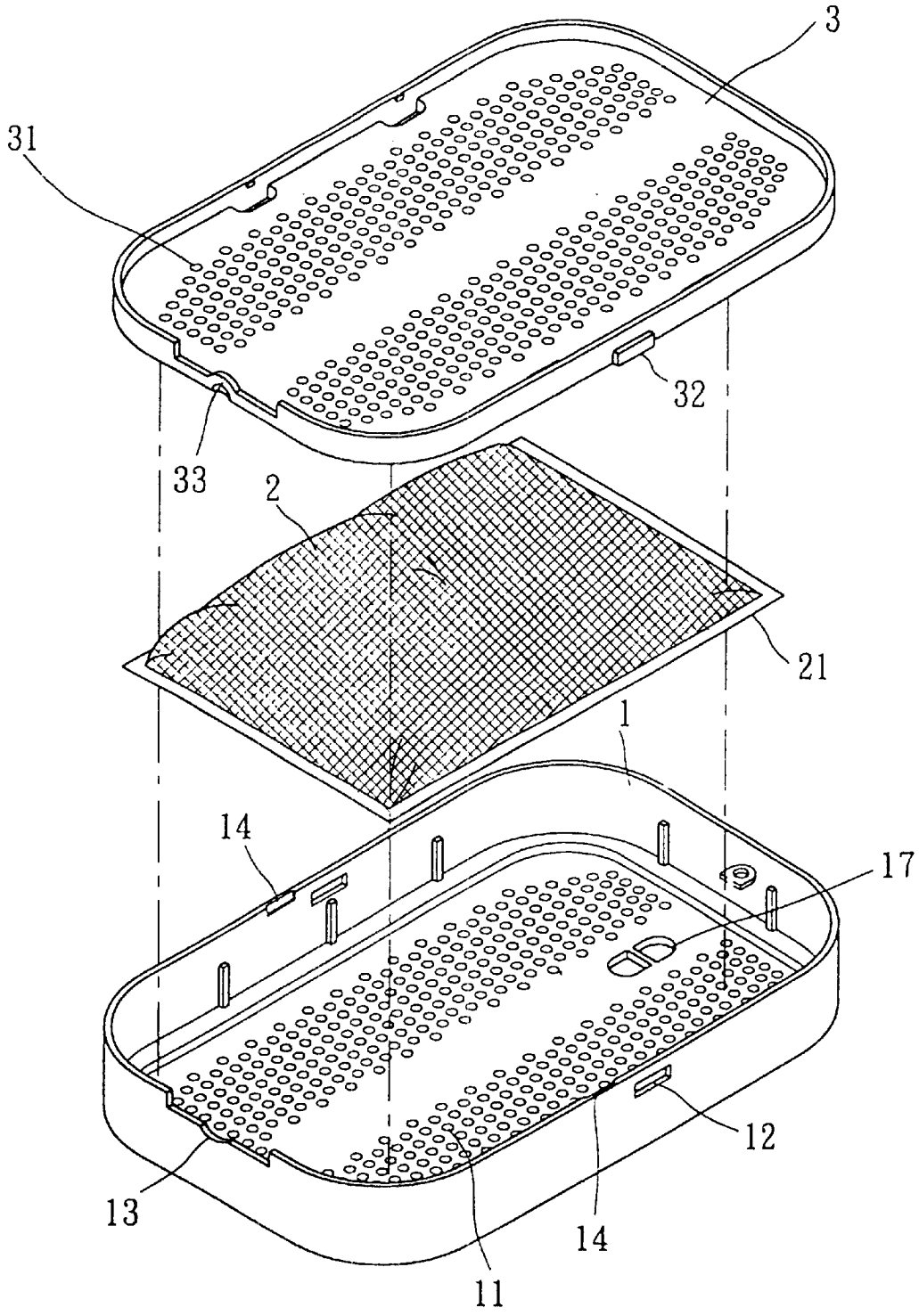
FIG. 4 is an exploded view of the dehumidifier shown in FIG. 3.

Referring to FIGS. 3 and 4, a dehumidifier is shown comprised of a casing 1, drying agent 2, and a bottom cover 3. The casing 1 comprises pores 11 and peepholes 17 through the top sidewall thereof, two retaining holes 12 respectively disposed in the vertical peripheral wall thereof at two opposite sides, a peripheral bottom notch 13 equally spaced from the retaining holes 12, and two recessed portions 14 respectively formed in the inner surface of the vertical peripheral wall at two sides adjacent to the retaining holes 12. The bottom cover 3 fits the bottom open side of the casing 1, comprising pores 31, two retaining blocks 32 disposed at two opposite sides and respectively forced into engagement with the retaining holes 12 of the casing 1, and a recessed portion 33 corresponding to the peripheral bottom notch 13 of the casing 1. After engagement of the retaining blocks 32 of the bottom cover 3 with the retaining holes 12 of the casing 1, a space is left in between the recessed portion 33 of the bottom cover 3 and the peripheral bottom notch 13 of the casing 1. The user can insert with the fingers into the space in between the recessed portion 33 of the bottom cover 3 and the peripheral bottom notch 13 of the casing 1 and the recessed portions 14 to remove the bottom cover 3 from the casing 1. Drying agent 2 is packed in a meshed bag of drying agent 21 and put in the casing 1. It changes the color subject to the amount of water absorbed. Through the peepholes 17, the user can visually check the status of water content of the drying agent 2 subject to the condition of the changing of color of the drying agent 2.

Figure 8:
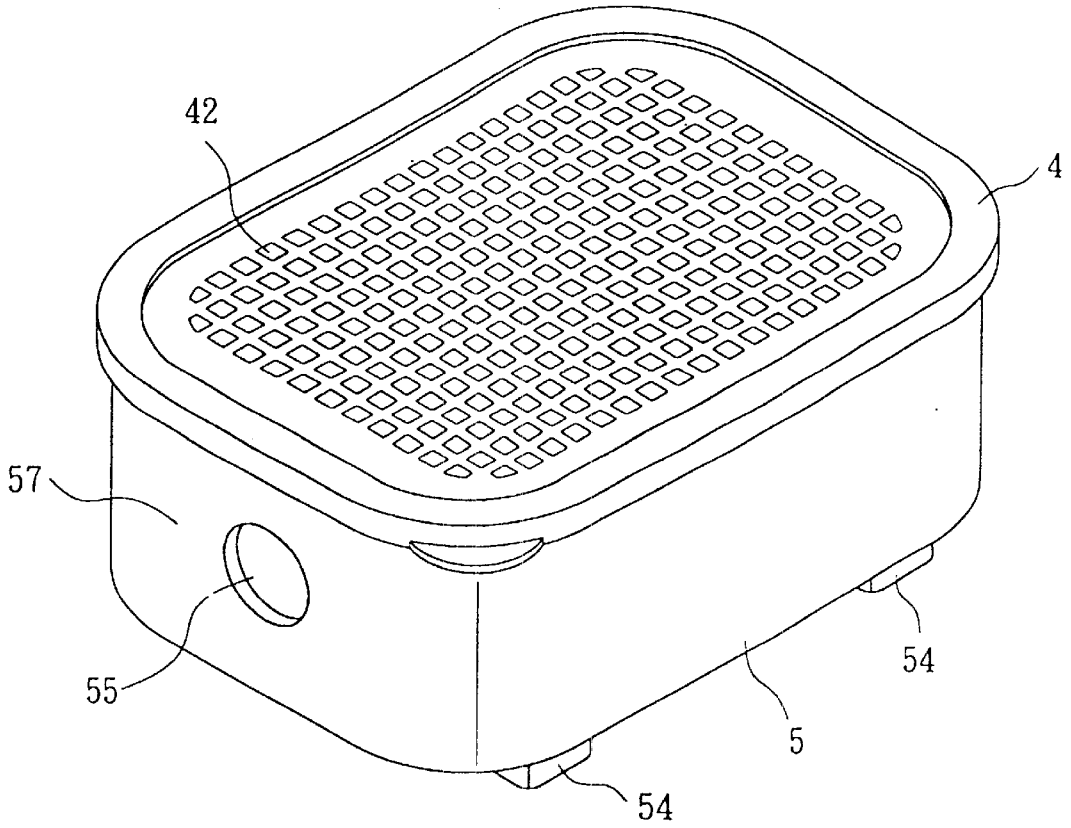
FIG. 8 is an elevational view showing the detachable seal cover covered on the drying box according to the present invention.

Referring to FIG. 8, a dehumidifier drying apparatus is shown comprised of a drying box 5, and a detachable seal cover 4 covered on the drying box 5.

Figure 5A:
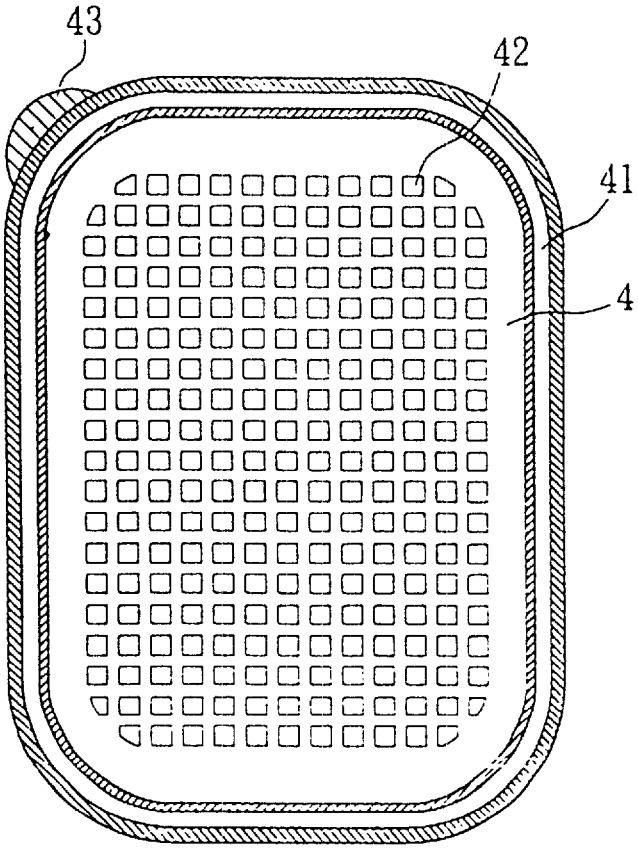
FIG. 5A is a bottom view of a detachable seal cover for a dehumidifier drying apparatus according to the present invention.
Figure 5B:
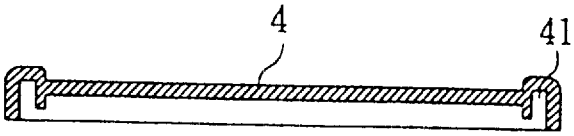
FIG. 5B is a side view of the detachable seal cover shown in FIG. 5A.

Referring to FIGS. 5A and 5B and FIG. 8 again, the detachable seal cover 4 comprises transversely longitudinally aligned air vents 42, a peripheral bottom coupling groove 41 forced into engagement with the topmost edge of the drying box 5, and a finger strip 43 extended from the periphery. Through the finger strip 43, the detachable seal cover 4 can easily pulled apart from the drying box 5. Preferably, the detachable seal cover 4 is injection-molded from plastics. The size of the detachable seal cover 4 fits the meshed bag of drying agent to be dried.

Figure 6A:
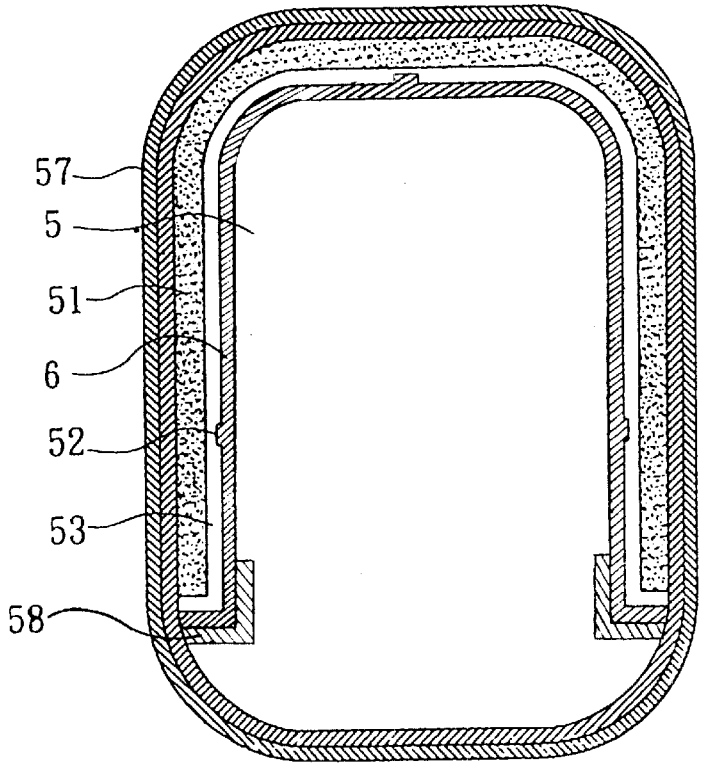
FIG. 6A is a bottom view of a drying box for a dehumidifier drying apparatus according to the present invention.
Figure 6B:
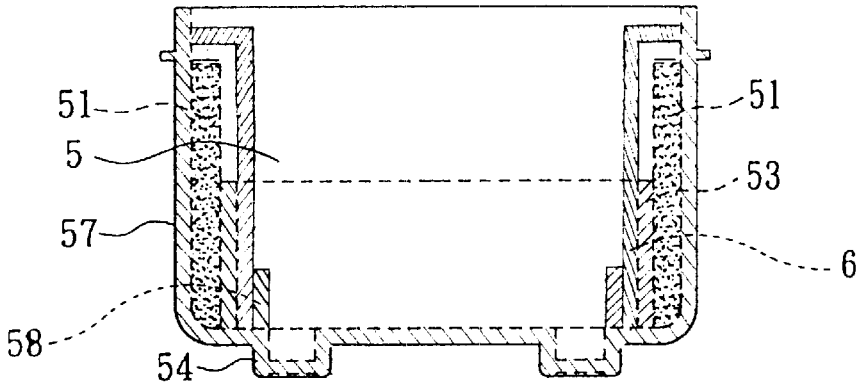
FIG. 6B is a side view of the drying box shown in FIG. 6A.

Referring to FIGS. 6A and 6B and FIG. 8 again, the drying box 5 is a top-open container comprising four foot members 54 symmetrically provided at the bottom sidewall thereof and adapted to support the drying box 5 on a flat surface and to keep the bottom sidewall of the drying box 5 away from the flat surface, an upright peripheral wall 57, a heat-resisting inner layer 53 injection-molded on the inside wall thereof and disposed in parallel to the upright peripheral wall 57, a layer of heat-insulating foamed material 51 stuffed in the space defined between the upright peripheral wall 57 and the heat-insulating inner layer 53, a heat-resisting covering 6 covered on the heat-resisting inner layer 53 to keep the layer of heat-insulating foamed material 51 from sight, and fenders 58 disposed on the inside and adapted to protect the heat-resisting covering 6 against deformation when hot.

Figure 7A:
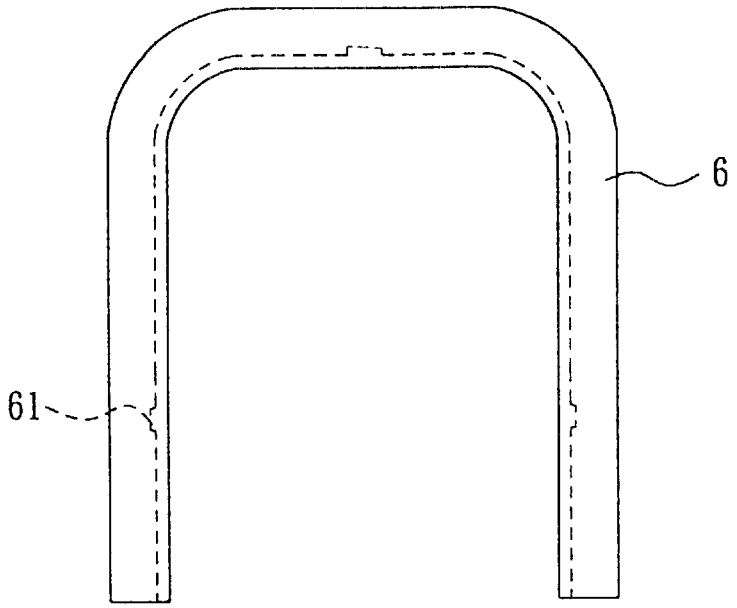
FIG. 7A is an enlarged view of a part of FIG.6A, showing the structure of the heat-resisting covering.
Figure 7B:
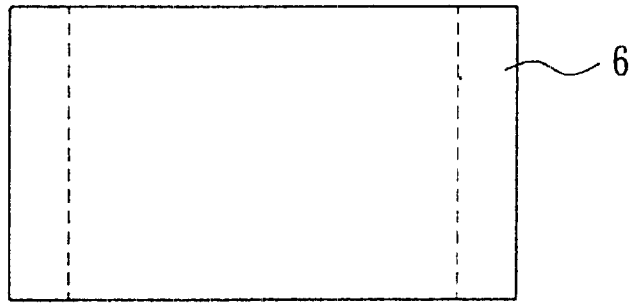
FIG. 7B is a side view of FIG. 7A.

Referring to FIGS. 7A and 7B and FIGS. 6A and 6B again, the heat-resisting inner layer 53 comprises a plurality of female retaining portions 52, and the heat-resisting covering 6 comprises a plurality of male retaining portions 61 respectively forced into engagement with the female retaining portions 52 of the heat-resisting inner layer 53.

Referring to FIG. 8 again, the drying box 5 further comprises a circular air inlet 55 through which hot current of air is driven into the inside of the drying box 5 and then forced out of the drying box 5 through the air vents 42 of the detachable seal cover 4 to dry water-absorbed drying agent put on the detachable seal cover 4.

Figure 9:
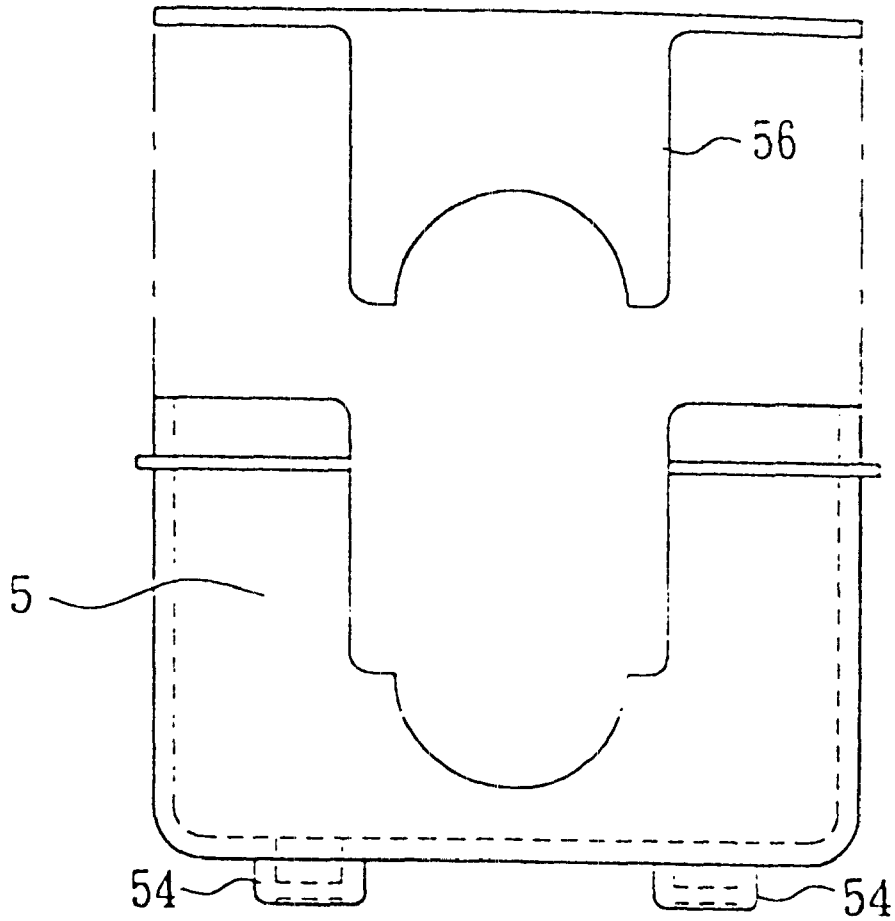
FIG. 9 illustrates an adjustable holding down plate provided inside the drying box and adjusted relative to the air inlet according to the present invention.

Referring to FIG. 9 and FIG. 8 again, an adjustable holding down plate 56 may be provided inside the drying box 5 and moved vertically to adjust the opening of the circular air inlet 55 subject to the diameter of the barrel (or barrel grille) of the hot air source (for example, a hair dryer) to be used. The adjustable holding down plate 56 preferably has its bottom side edge smoothly curved inwards to fit the circular periphery of the circular air inlet 55.

Figure 10:
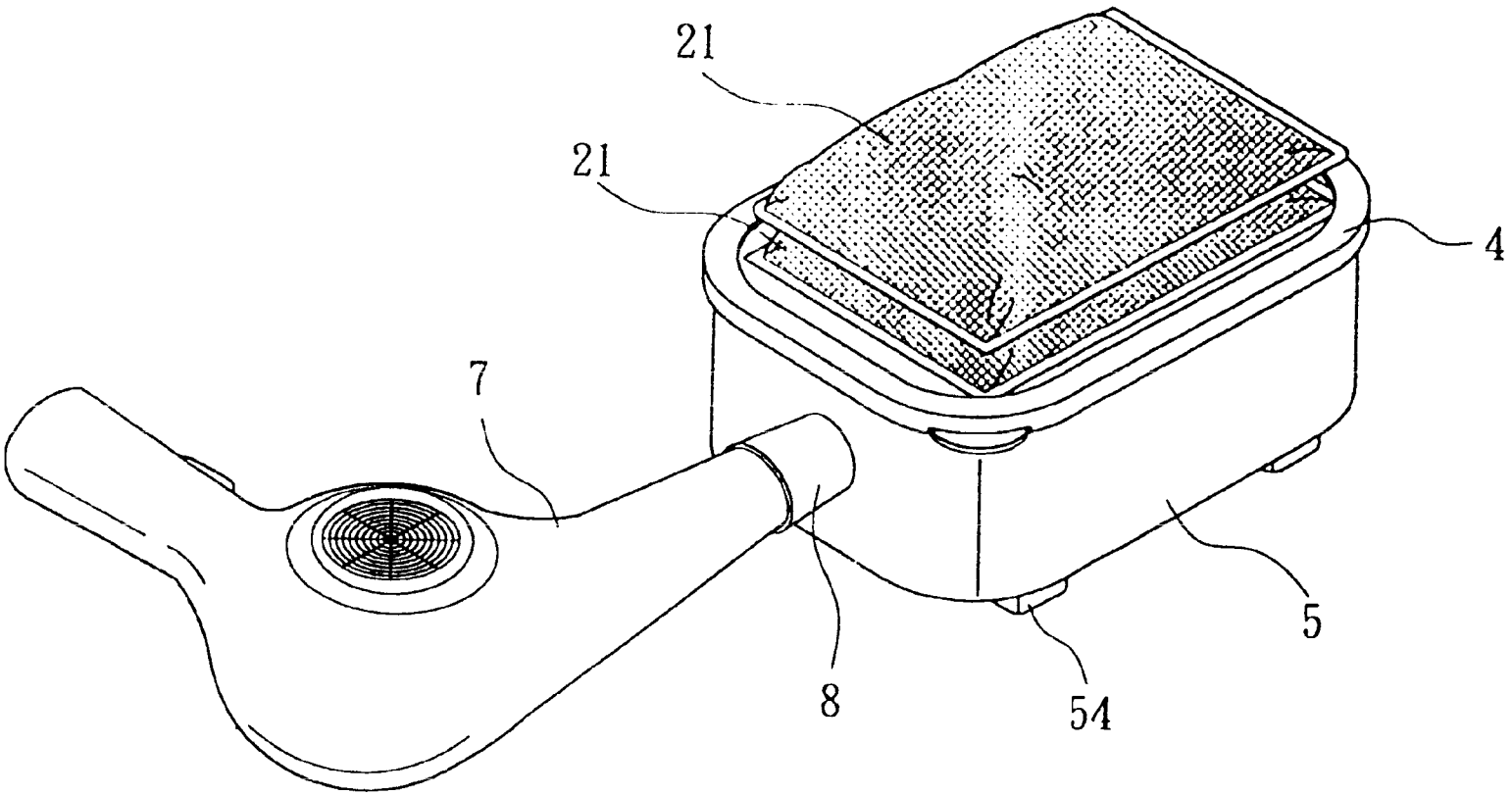
FIG. 10 shows a heat-resisting socket installed in the circular air inlet of the drying box, the barrel of a hair dryer inserted into the heat-resisting socket according to the present invention.

Referring to FIG. 10 and FIG. 8 again, a heat-resisting socket 8 may be installed in the circular air inlet 55 to receive the barrel (or barrel grille) of a hair dryer 7, enabling hot air to be driven into the inside of the drying box 5 and then forced out of the drying box 5 through the air vents 42 of the detachable seal cover 4 to dry meshed bags of water-absorbed drying agent 21 put on the detachable seal cover 4.

A prototype of dehumidifier drying apparatus has been constructed with the features of FIGS. 3~10. The dehumidifier drying apparatus functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A dehumidifier drying apparatus, comprising:

a drying box with an open top side and an air inlet in an upright peripheral wall of said drying box, said drying box receiving hot air from a hot air source, and a detachable seal cover covering said open top side of said drying box, said seal cover holding at least one saturated meshed bag of drying agent, said seal cover comprising a plurality of air vents through which hot air is delivered from said air inlet to said saturated meshed bag of drying agent; wherein said hot air source blows hot air through said air inlet of said drying box and said air vents of said detachable seal cover to dry said saturated meshed bag of drying agent, and wherein said drying box comprises an adjustable holding down plate, said adjustable plate being movable to control a size of an opening of said air inlet.

2. The dehumidifier drying apparatus of claim 1 wherein:

a size of said detachable seal cover corresponds to a size of said meshed bag of drying agent.

3. A dehumidifier drying apparatus, comprising:

a drying box with an open top side and an air inlet in an upright peripheral wall of said drying box, said drying box receiving hot air from a hot air source, and a detachable seal cover covering said open top side of said drying box, said seal cover holding at least one saturated meshed bag of drying agent, said seal cover comprising a plurality of air vents through which hot air is delivered from said air inlet to said saturated meshed bag of drying agent; wherein said hot air source blows hot air through said air inlet of said drying box and said air vents of said detachable seal cover to dry said saturated meshed bag of drying agent, and wherein said detachable seal cover comprises a peripheral bottom coupling groove forced into engagement with a topmost edge of said upright peripheral wall of said drying box.

4. A dehumidifier drying apparatus, comprising:

a drying box with an open top side and an air inlet in an upright peripheral wall of said drying box, said drying box receiving hot air from a hot air source, and a detachable seal cover covering said open top side of said drying box, said seal cover holding at least one saturated meshed bag of drying agent, said seal cover comprising a plurality of air vents through which hot air is delivered from said air inlet to said saturated meshed bag of drying agent; wherein said hot air source blows hot air through said air inlet of said drying box and said air vents of said detachable seal cover to dry said saturated meshed bag of drying agent, and wherein said drying box comprises a heat-resisting inner layer injection-molded on an inside wall of said drying box, said heat-resisting inner layer being disposed parallel to said upright peripheral wall of said drying box, there being a space defined between said upright peripheral wall and said heat-resisting inner layer, said space being adapted to receive insulating material.

* * * * *